US005122818A

United States Patent [19]

Elrod et al.

[11] Patent Number: 5,122,818

[45] Date of Patent: Jun. 16, 1992

[54] ACOUSTIC INK PRINTERS HAVING REDUCED FOCUSING SENSITIVITY

[75] Inventors: Scott A. Elrod, Menlo Park; Edward A. Richley, Mountain View; Eric G. Rawson, Saratoga, all of Calif.

[73] Assignee: Xerox Corporation, Stamford, Conn.

[21] Appl. No.: 682,859

[22] Filed: Apr. 5, 1991

Related U.S. Application Data

[63] Continuation of Ser. No. 462,275, Dec. 26, 1989, abandoned, which is a continuation of Ser. No. 287,791, Dec. 21, 1988.

[51] Int. Cl.[5] ..... B41J 2/04

[52] U.S. Cl. ..... 346/140 R

[58] Field of Search ..... 346/140 R

[56] References Cited

U.S. PATENT DOCUMENTS 4,308,547 12/1981 Lovelady ..... 346/140
4,751,529 4/1988 Elrod ..... 346/140
4,751,530 6/1988 Elrod ..... 346/140
4,751,534 6/1988 Elrod ..... 346/140
4,782,350 11/1988 Smith ..... 346/140

*Primary Examiner*—Joseph W. Hartary

[57] ABSTRACT

To improve the tolerance of acoustic ink printers to changes in their free ink surface levels, provision is made for significantly reducing the effect of half wave resonances on the acoustic power density of the acoustic beam or beams that are incident on the free ink surface of such a printer, thereby reducing its focusing sensitivity. Some of the approaches that are taken to accomplish this rely upon acoustic losses to damp out the halfwave resonances and anti-resonances, while others employ multi-frequency rf voltage pulses for driving the droplet ejector or ejectors so that the acoustic power perturbations caused by the half wave resonances and anti-resonances of the different frequencies tend to neutralize each other. Indeed, the use of an acoustically lossy ink to dampen the half wave resonances and anti-resonances is compatible with selecting the frequency content of the acoustic radiation to neutralize them, so a combination of those two techniques can be employed, if desired, to carry out this invention.

6 Claims, 4 Drawing Sheets

ACOUSTIC INK PRINTERS HAVING REDUCED FOCUSING SENSITIVITY

This is a continuation of application Ser. No. 07/462,275, filed Dec. 16, 1989, which, in turn, was a continuation of application Ser. No. 07/287,791 filed Dec. 21, 1988

FIELD OF THE INVENTION

This invention relates to acoustic ink printers and, more particularly, to methods and means for reducing their focusing sensitivity.

BACKGROUND OF THE INVENTION

Acoustic ink printing is a promising direct marking technology. It potentially is an attractive alternative to ink jet printing because it has the important advantage of obviating the need for the nozzles and small ejection orifices that have caused many of the reliability and picture element (i.e., "pixel") placement accuracy problems which conventional drop on demand and continuous stream ink jet printers have experienced.

Acoustic ink printers of the type to which this invention pertains characteristically include one or more droplet ejectors for launching respective converging acoustic beams into a pool of liquid ink, typically so that the principal or chief ray of each beam is at a near normal angle of incidence with respect to the free surface of the ink, with the angular convergence of each beam being selected so that it comes to focus essentially on the free ink surface. Printing usually is performed by modulating the radiation pressure each beam exerts against the free ink surface. This modulation enables the effective pressure of each beam to make brief, controlled excursions to a sufficiently high pressure level for overcoming the restraining force of surface tension by an adequate margin to eject individual droplets of ink from the free ink surface on command at a sufficient velocity to cause the droplets to deposit in an image configuration on a nearby recording medium.

Prior work has demonstrated that acoustic ink printers having droplet ejectors composed of acoustically illuminated spherical focusing lenses can print precisely positioned pixels at a sufficient resolution for high quality printing of relatively complex images. See, for example, commonly assigned U.S. patent applications of Elrod et al, which were filed on Dec. 19, 1986 under Ser. Nos. 944,490, 944,698 now U.S. Pat. No. 4,751,530 and 944,701 on "Microlenses for Acoustic Printing", "Acoustic Lens Array for Ink Printing", and "Sparse Arrays for Acoustic Printing", respectively. It also has been shown that provision can be made in such printers for dynamically varying the size of the pixels they are printing, thereby facilitating, for example, the printing of variable gray level images. See another commonly assigned U.S. patent application of Elrod et al., which was filed on Dec. 19, 1986 on "Variable Spot Size Acoustic Printing."

Although acoustic lenses currently are a favored focusing mechanism for the droplet ejectors of acoustic ink printers, it is to be understood that there are known alternatives; including (1) piezoelectric shell transducers, such as described in Lovelady et al U.S. Pat. No. 4,308,547, which issued Dec. 29, 1981 on a "Liquid Drop Emitter," and (2) planar piezoelectric transducers having concentric interdigitated electrodes (IDT's), such as described in a copending and commonly assigned Quate et al U.S. patent application, which was filed Jan. 5, 1987 under Ser. No. 946,682 on "Nozzleless Liquid Droplet Ejectors" as a continuation of application Ser. No. 776,291 filed Sep. 16, 1985 (now abandoned). Furthermore, it will be apparent that the existing droplet ejector technology is sufficient for designing various printhead configurations, including (1) single ejector embodiments for raster scan printing, (2) matrix configured ejector arrays for matrix printing, and (3) several different types of pagewidth ejector arrays, ranging from (i) single row, sparse arrays for hybrid forms of parallel/serial printing to (ii) multiple row, staggered arrays with individual ejectors for each of the pixel positions or addresses within a pagewidth image field (i.e., single ejector/pixel/line) for ordinary line printing. As will be appreciated, practical considerations can influence or even govern the choice of droplet ejectors for some printhead configurations, so the above-identified patent applications are hereby incorporated by reference to supplement this general overview.

Preferably, the size droplets of ink that are ejected by an acoustic ink printer, as well as the velocity at which they are ejected, are substantially unaffected by minor variations in the free ink surface level of the printer, such as may be caused by the gradual depletion and/or evaporation of the ink. Relatively straightforward provision may be made to compensate for readily detected changes in the level of the free ink surface, but it is technically difficult and more costly to detect small surface level changes with the precision that is required to compensate for them effectively. Accordingly, the tolerance of acoustic ink printers to slight changes in their free ink surface levels is an important consideration.

Unfortunately, prior acoustic ink printers have been overly sensitive to variations in their free ink surface levels. For example, spherical acoustic focusing lenses having a usable depth of focus on the order of one wavelength of the acoustic radiation in the ink have been developed for such printers. However, it has been found that variations of only one quarter wavelength or even less in the free ink surface levels of printers embodying these lenses tend to materially affect the size of the droplets that are ejected and the velocity at which they are ejected. Research indicates that the half wave resonances which are created because of acoustic reflections within the resonant cavity or cavities of these printers are a principal cause of this problem.

As will be understood, most of the incident acoustic radiation generally is reflected from the free ink surface of an acoustic ink printer because the ink/air interface inherently is acoustically mismatched. Moreover, the ink necessarily is contained within a finite acoustic cavity, so a significant portion of the reflected radiation tends to be returned to the ink surface after being reflected either from the droplet ejector/ink interface or from an acoustically mismatched interface at the rear of the droplet ejector, depending upon whether the droplet ejector is acoustically matched to the ink or not. Typically, the roundtrip propagation time for the return of the reflected radiation to the free ink surface is shorter than the duration of the very narrow band (i.e., single frequency) rf tone bursts that have been proposed for driving the droplet ejectors of prior acoustic ink printers, so the reflected and the non-reflected radiation that are incident on the free ink surface coherently interfere. This interference may be constructive, destructive, or partially constructive and partially destructive, but the free ink surface levels at which resonant constructive interference and anti-resonant destructive interference occur differ from each other by only one quarter of the wavelength of the acoustic radiation in the ink. Consequently, variations as small as one quarter wavelength or even less in the free ink surface level can significantly alter the effective radiation pressure of the focused beam or beams, unless suitable provision is made to prevent or suppress those resonances.

SUMMARY OF THE INVENTION

In accordance with the present invention, provision is made for significantly reducing the effect of half wave resonances on the acoustic power density of the acoustic beam or beams that are incident on the free ink surface of an acoustic ink printer, thereby reducing its focusing sensitivity. Some of the approaches that are taken to accomplish this rely upon acoustic losses to damp out the halfwave resonances and anti-resonances, while others employ multi-frequency rf voltage pulses for driving the droplet ejector or ejectors so that the acoustic power perturbations caused by the half wave resonances and anti-resonances of the different frequencies tend to neutralize each other. Indeed the use of an acoustically lossy ink to dampen the half wave resonances and anti-resonances is compatible with selecting the frequency content of the acoustic radiation to neutralize them, so a combination of those two techniques can be employed, if desired, to carry out this invention.

BRIEF DESCRIPTION OF THE DRAWINGS

Still other features and advantages of this invention will become apparent when the following detailed description is read in conjunction with the attached drawings. in which.

DETAILED DESCRIPTION OF THE ILLUSTRATED EMBODIMENTS

While the invention is described in some detail hereinbelow with reference to certain illustrated embodiments, it is to be understood that there is no intent to limit it to those embodiments. On the contrary, the aim is to cover all modifications, alternatives and equivalents falling within the spirit and scope of the invention as defined by the appended claims.

Figure 1:
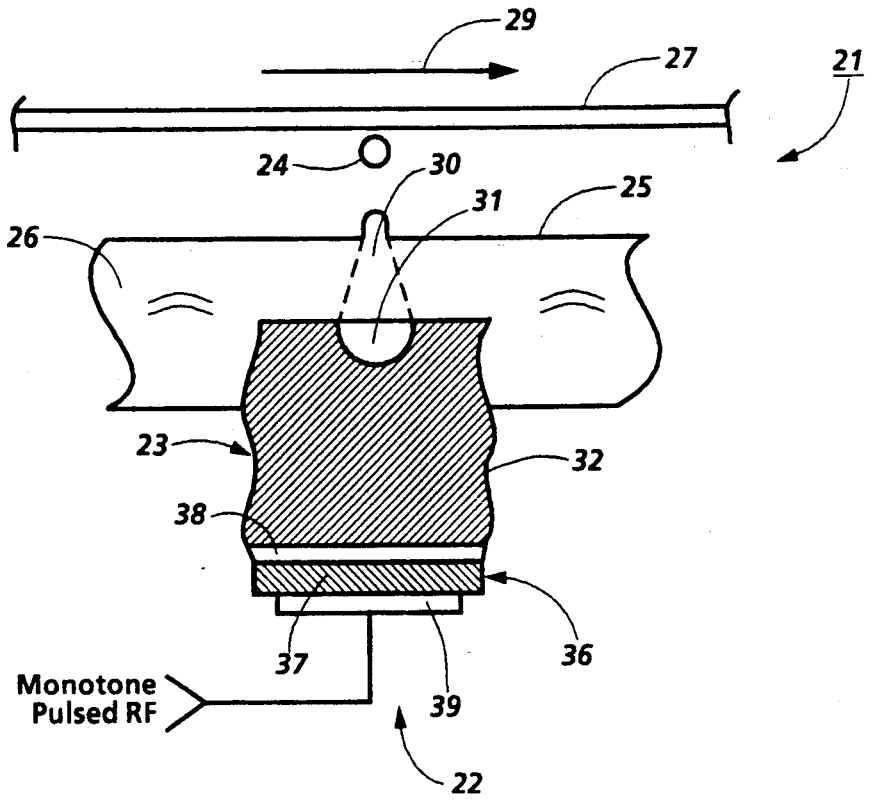
Fig. 1 (Prior Art)
FIG. 1 is a simplified, fragmentary, sectional view of an acoustic ink printer.

Turning now to the drawings, and at this point especially to FIG. 1, there is an acoustic ink printer 21 (shown only in relevant part) having a printhead 22 comprising one or more droplet ejectors 23 (only one can be seen) for ejecting individual droplets of ink 24 on command from the free surface 25 of a liquid ink supply 26 at an ejection velocity that is sufficient to cause them to deposit promptly in an image configuration on a nearby recording medium 27. As shown, the droplet ejectors 23 are immersed in the ink 26, but it will be evident that they could be acoustically coupled to the ink 26 by one or more liquid or solid, intermediate acoustic coupling media (not shown). Moreover, in the illustrated embodiment, the recording medium 27 is advanced during operation at a predetermined rate (by means not shown) in the cross-line or process direction relative to the printhead 22, as indicated by the arrow 29, such as for line printing by a pagewidth array of droplet ejectors 23. It, however, will be understood that the relative motion between the printhead 22 and the recording medium 27 could be modified as required to accommodate different printhead configurations and different printing patterns.

In operation, each of the droplet ejectors 23 launches a converging acoustic beam 30 into the liquid ink 26, such that the principal or chief ray of the beam 30 is at a near normal angle of incidence with respect to the free ink surface 25. In keeping with prior teachings, the angular convergence of each beam 30 is selected to cause it to come to focus essentially on the free ink surface 25. Furthermore, the radiation pressure which each beam 30 exerts against the free ink surface 25 is modulated in accordance with the image data applied to the corresponding droplet ejector 23, whereby the radiation pressure is briefly elevated to a level above the threshold pressure for the onset of droplet ejection whenever there is a "black" pixel to be printed and maintained at a level below that threshold whenever there is a "white" pixel to be printed.

As illustrated, each of the droplet ejectors 23 suitably comprises a spherical acoustic focusing lens 31 which is defined by small spherical depression or indentation in the upper or anterior face of a substrate 32. Although only one lens 31 can be seen, it will be understood that many of them could be distributed on spaced apart centers across the upper face of the substrate 32 if it is desired, for example, to provide a pagewidth printhead having a one or two dimensional array of droplet ejectors 23. Regardless, however, of the specific configuration of the printhead 22, the substrate 32 is composed of a material, such as silicon, silicon nitride, silicon carbide, alumina, sapphire, fused quartz and certain glasses, having an acoustic velocity which is substantially higher than the acoustic velocity of the ink 26. A printhead 22 having a single droplet ejector 23 adequately illustrates the problem to which this invention is addressed and the solutions that are provided, so the remainder of this disclosure will be simplified by assuming that the printhead 22 has just one focusing lens 31.

Figure 2:
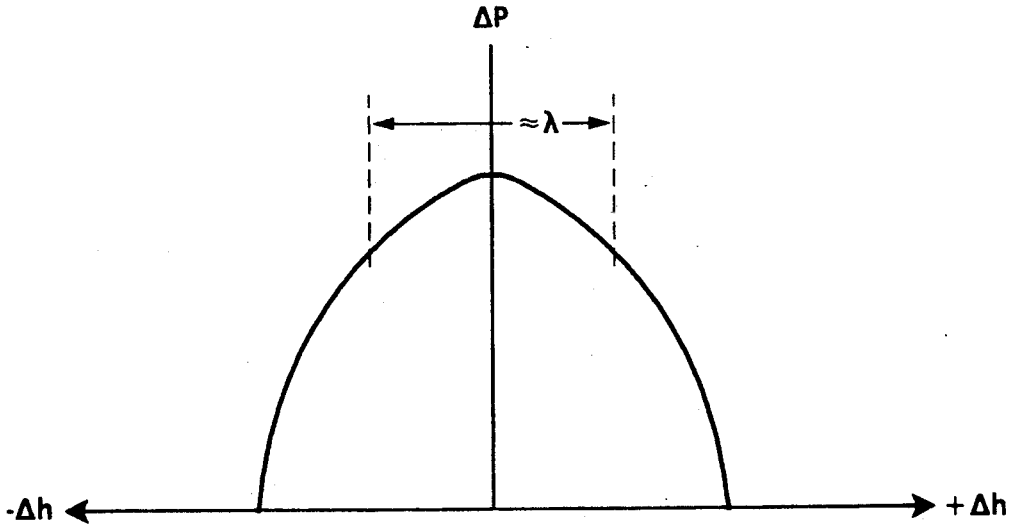
FIG. 2 diagrammatically illustrates the general manner in which the acoustic power density in the center of the focal spot at the free ink surface of the printer shown in FIG. 1 would vary as a function of surface level changes in the absence of half wave resonances.

To illuminate the lens 31, a piezoelectric transducer 36, which is deposited on or otherwise intimately bonded to the lower or posterior face of the substrate 32, is excited into oscillation during operation by a pulse modulated rf voltage that is applied across it, thereby coupling an acoustic wave into the substrate 32. Suitably, the transducer 36 is composed of a piezoelectric film 37, such as a zinc oxide (ZnO) film, which is sandwiched between a pair of electrodes 38 and 39, but it will be apparent other piezoelectric materials and transducer configurations could be employed. The lens 31, in turn, reshapes the wavefront of the incident acoustic radiation, thereby launching it into the ink 26 as a converging acoustic beam 30 which comes to focus substantially on the free ink surface 25. As shown in FIG. 2, the acoustic power density at the free ink surface 25 inherently varies as a function of the ink surface level because of the focusing properties of the acoustic beam 30. However, in the absence of other factors, the level of the free ink surface 25 could vary over a range determined by the usable depth of focus of the lens 31 (e.g., a range on the order of the wavelength, $\lambda$, of the acoustic radiation in the ink 26 if the lens 31 has a $F\# \approx 1$), without materially affecting the radiation pressure the beam 30 exerts against it.

Figure 3:
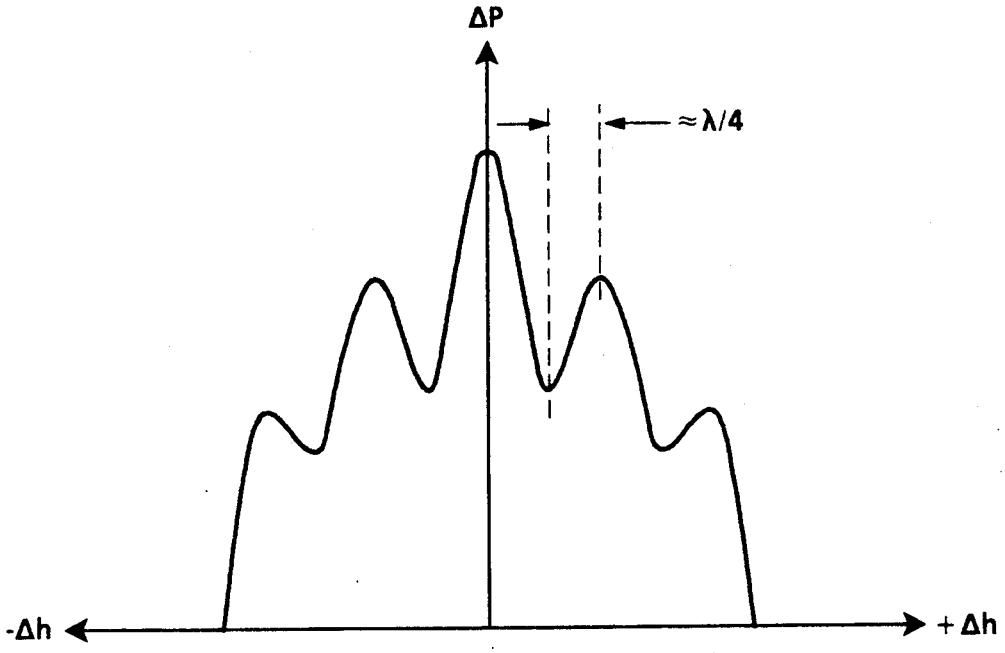
FIG. 3 diagrammatically illustrates the effect of single frequency half wave resonances on the tolerance of the printer shown in FIG. 1 to variations in its free ink surface level.

Unfortunately, as shown in FIG. 3, half wave resonances commonly have been a dominant, although unrecognized, factor in determining the focusing sensitivity of prior acoustic ink printers. As previously pointed out, such resonances commonly occur because of coherent interference between the previously unreflected and the reflected components of the acoustic radiation that is incident on the free ink surface 25. Moreover, the boundary conditions on the free ink surface level for resonant constructive interference and anti-resonant destructive interference differ from each other by only one quarter wavelength. Therefore, whenever the free ink surface level of the printer 21 (FIG. 1) varies by as little a one quarter wavelength or even less, the efficiency with which acoustic power is transferred from its droplet ejector or ejectors 23 to its free ink surface 25 (i.e., the acoustic coupling efficiency) tends to fluctuate sufficiently to affect the size of the droplets that are ejected and/or the velocity at which they are ejected significantly.

One possible solution to this problem is to utilize lossy inks for acoustic ink printing, whereby the half wave resonances are so attenuated that they have little, if any, effect. The acoustic loss (dB/m) caused by the ink 26 (FIG. 1) tends to be greater for inks of higher viscosity, so it is noted that a meaningful reduction in the amplitude of the troublesome half wave resonances has been observed with inks having absolute viscosities well above that of water and that half wave resonances do not seem to materially affect the focusing sensitivity of acoustic ink printers employing inks having even higher absolute viscosities. The particular viscosities at which significant damping of the half wave resonances occur are dependent upon the acoustic path length in the ink 26 and on the rf frequency employed, but a readily noticeable reduction in the acoustic power perturbations at the free ink surface 25 typically will be observed when employing inks having absolute viscosities on the order of at least 5–10 centipoise. As will be appreciated, lossy inks are a partial or complete solution to the half wave resonance problem because they cause substantial attenuation of the reflected radiation during its roundtrip return to the free ink surface 25, thereby reducing the magnitude of the perturbation it produces.

Figure 4:
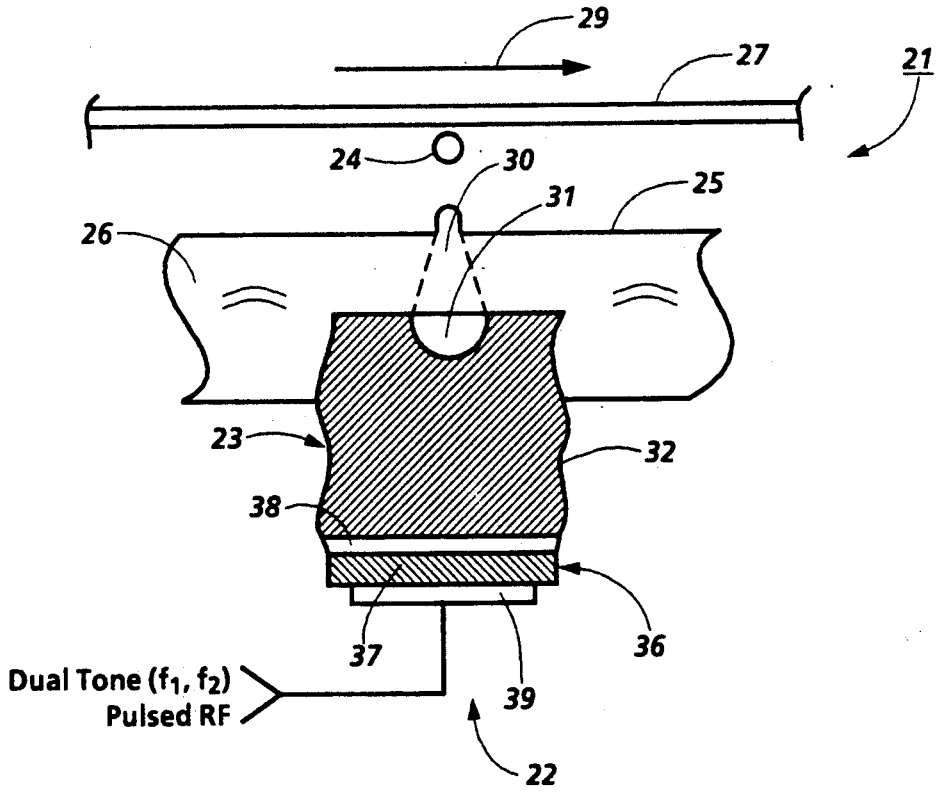
FIG. 4 is a simplified, fragmentary, sectional view of an acoustic ink printer which is driven by dual frequency rf pulses to suppress half wave resonances in accordance with one aspect of this invention.

Another approach, which may be used alone or in combination with lossy inks, for desensitizing acoustic ink printers to half wave resonances is to drive the droplet ejector or ejectors 23 of the printer 21 with multifrequency rf tone bursts, such that the power perturbations caused by the resonances of one frequency component substantially offset or neutralize the perturbations caused by the anti-resonances of another frequency component, and vice-versa. More particularly, referring to the dual tone case illustrated in FIG. 4, it will be understood that if the resonances of the lens substrate 32 and of the transducer 36 (i.e., the printhead 22) are ignored, a free ink surface level at which one frequency, $f_1$, is resonant and another frequency $f_2$, is anti-resonant can be determined as a function of the displacement, $l_i$, of the free ink surface 25 from the central portion of the lens surface (i.e., the "acoustical center" of the lens 31). The acoustic impedance of the lens substrate 32 characteristically is higher than that of the ink 26, so the acoustic velocity field undergoes a 180° phase shift upon reflection at the lens/ink interface. Thus, an anti-resonance occurs whenever the free ink surface 25 is displaced an integer number, n, of half wavelengths from the acoustical center of the lens 31, so an anti-resonant condition exists for the frequency $f_1$ if:

$$f_1 = nV_i/2l_i \tag{1}$$

where: $V_i$=the velocity of sound in the ink.

On the other hand, a resonance occurs whenever the free ink surface 25 is displaced on odd integer number of quarter wavelengths from the acoustical center of the lens 31, so an resonant condition exists for the frequency $f_2$ if:

$$f_2 = nV_i/2l_i + V_i/4l_i \tag{2}$$

Figure 5:
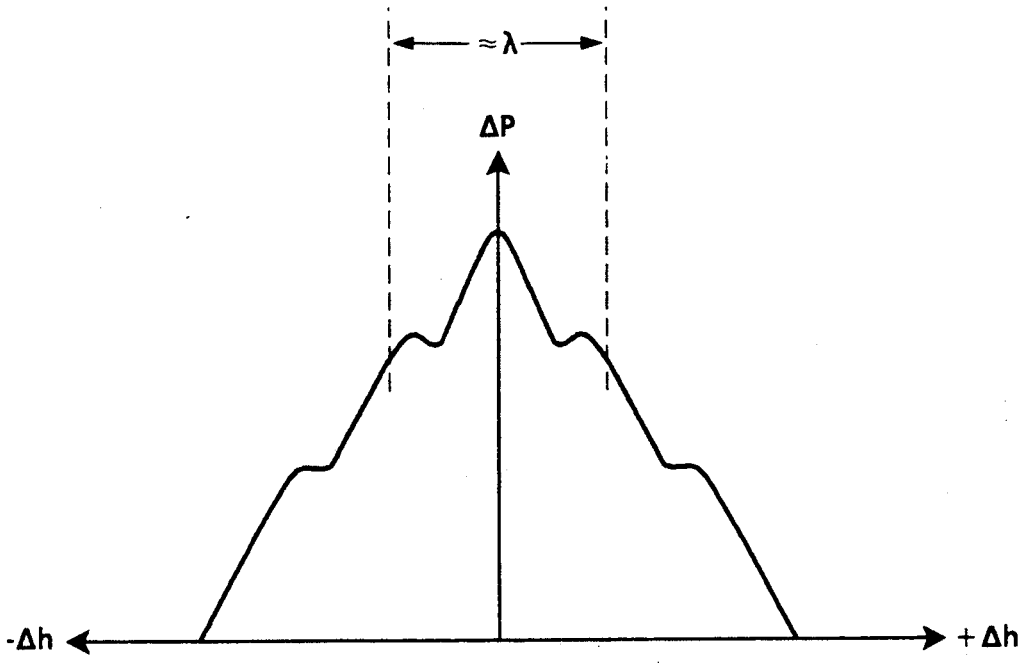
FIG. 5 diagrammatically illustrates the increased tolerance of the printer shown in FIG. 4 to variations in its free ink surface level.
Figure 7:
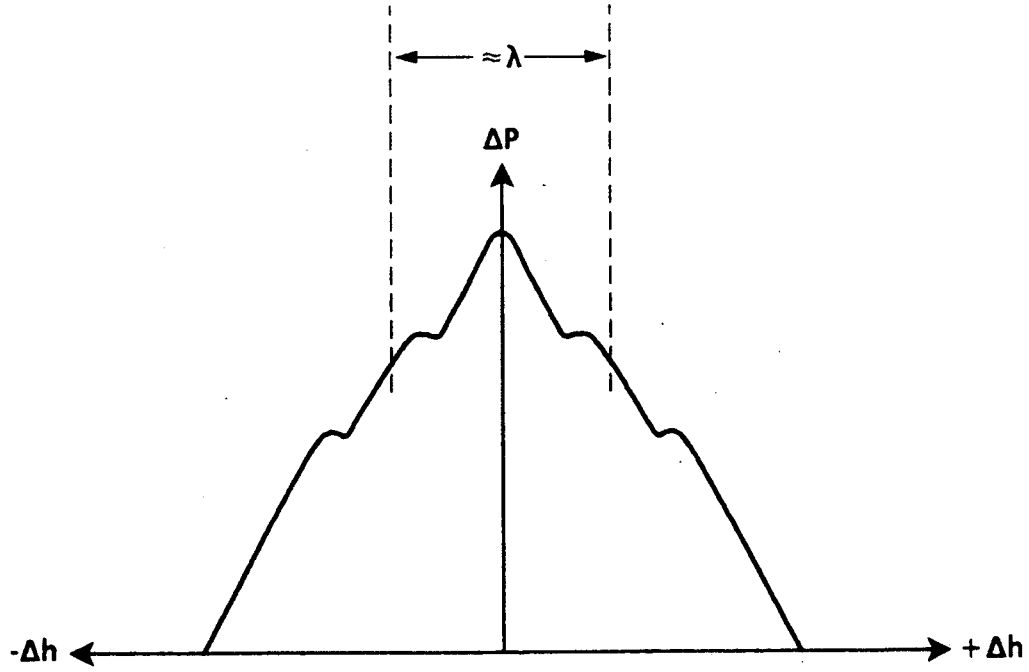
FIG. 7 diagrammatically illustrates the near optimum tolerance of the printer shown in FIG. 6 to variations in its free ink surface level.

It, therefore, follows that if the two rf frequencies, $f_1$ and $f_2$, are selected so that their frequency separation, $\Delta f_i$, in the ink 26 is:

$$\Delta f_i = V_i/4l_i \tag{3}$$

the power perturbations caused by their resonances and anti-resonances will tend to neutralize each other, thereby reducing the sensitivity of the printer 21 to minor variations in its free ink surface level. See FIG. 5.

Figure 6:
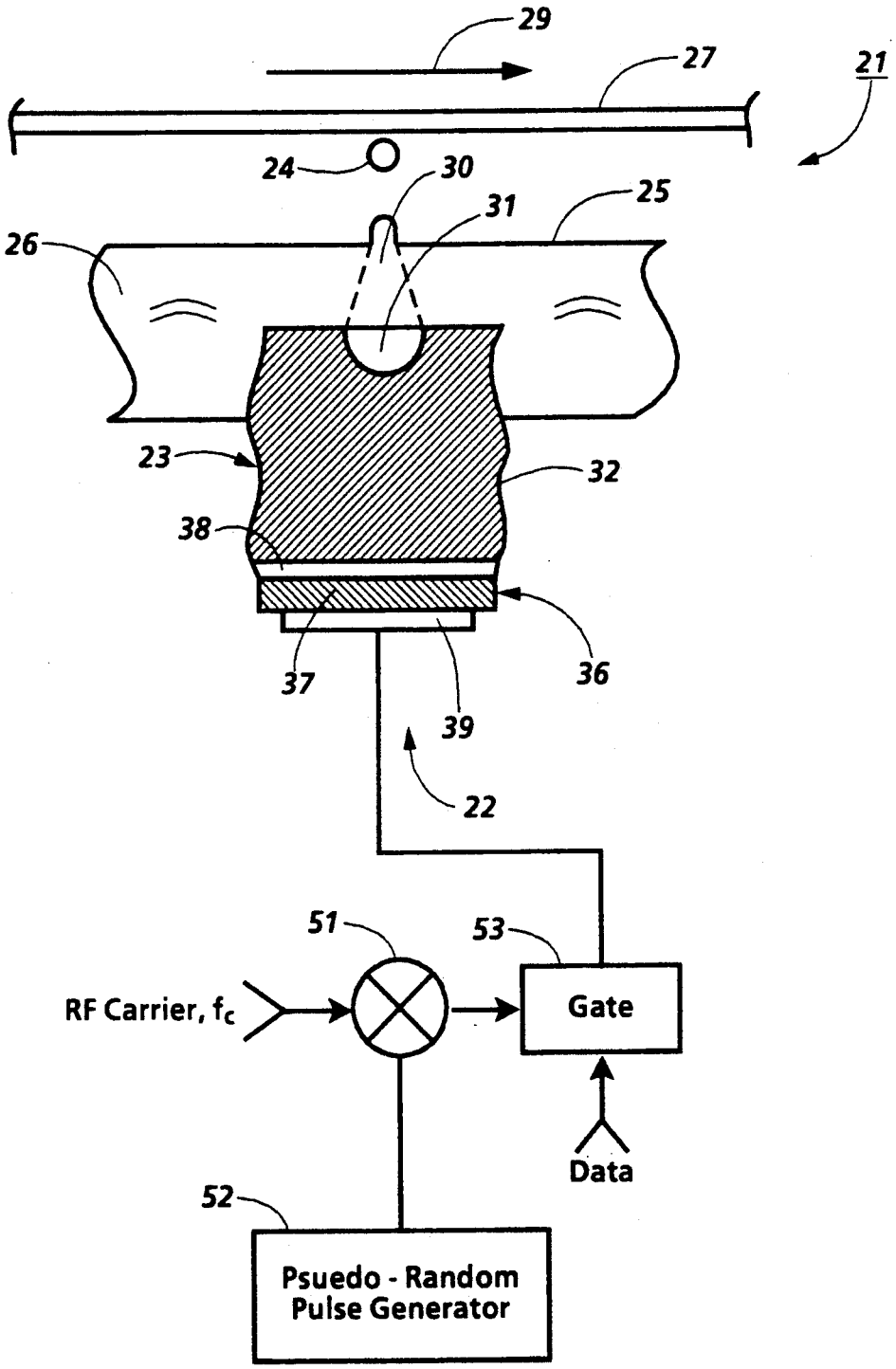
FIG. 6 is a simplified, fragmentary, sectional view of an acoustic ink printer which is driven by multi-frequency rf pulses to even further suppress half wave resonances.

To even further reduce the effect of half wave resonances on the power density at the free ink surface 25, the frequency content of the rf drive pulses may be increased. For example, as shown in FIG. 6, a mixer 51 may be employed for mixing an rf carrier, such as a 150 MHz carrier, with a cyclical psuedo-random bit sequence signal having a frequency up to about 20 MHz, such that the drive pulses that are applied to the transducer 36 by a switch or modulator 53 are composed of a large number of rf frequencies ranging from about 130 MHz to about 170 MHz. Suitably, the psuedo-random bit sequence signal is supplied by a psuedo-random bit generator 52 which cycles at the data rate of the printer 21(i.e., the rate at which data bits are applied to the modulator 53), thereby ensuring that the rf power of the drive pulses applied to the transducer 36 is substantially uniform. Alternatively, a linear chirp signal could be employed to modulate the rf carrier frequency, but this has the disadvantage of requiring that the carrier be frequency modulated at a high rate. Still another alternative that may suggest itself is to employ data modulated, essentially "white" rf noise for driving the transducer 36, but that approach is not a favored because the rf power level of such noise may differ considerably from pulse-to-pulse.

Considering the acoustic coupling characteristics of the illustrated acoustic ink printer in some additional detail, it will be understood that its printhead 22 is a resonator which is only weakly coupled to the ink 26, unless the printhead 22 is acoustically matched to the ink 26, such as by coating the lens or lenses 31 with a quarter wavelength acoustic matching layer (not shown). Moreover, even if such an acoustic matching layer is used at the printhead/ink interface, the acoustic coupling efficiency is likely to vary as a function of frequency. In the dual tone embodiment of FIG. 4, the amplitudes of the two frequency components, $f_1$ and $f_2$, can be scaled as required to ensure that their resonances and anti-resonances substantially equally and oppositely perturb the acoustic power at the free ink surface 25. However, when a broad spectrum rf source is employed, such as in FIG. 6, it is simpler to design the source so that it has a relatively flat amplitude across its entire frequency spectrum. Thus, for those embodiments, it is advisable to use a printhead 22 with a resonant cavity length, $l_s$, which is much greater than the thickness or resonant cavity length, $l_i$, of the liquid ink layer 26. The frequency spacing, $\Delta f_s$ and $\Delta f_i$, of the half wave resonances in the printhead 22 and the ink 26, respectively, are given by:

$$\Delta f_s = V_s/2l_s \quad (4)$$

and $$\Delta f_i = V_i/2l_i \quad (5)$$

Thus, if due consideration is given to the difference between the velocity of sound in the printhead 22 and in the ink 26, their resonant cavity lengths, $l_s$ and $l_i$, can be selected to cause the the printhead resonances to have a much finer frequency spacing than the ink resonances. Accordingly, many of the frequency components of the rf source will couple from the lens or lenses 31 into the ink 26 within the passband of each resonance of the ink 26, thereby exciting the ink 26 with a sufficient spectrum of frequencies to ensure that the power perturbations caused by the half wave resonances and anti-resonances of the individual frequencies substantially neutralize each other.

CONCLUSION

In view of the foregoing, it will now be understood that the present invention reduces the effect of half wave resonances on the focusing sensitivity of acoustic ink printers, thereby increasing the tolerance of such printers to variations in their free ink surface levels. Furthermore, it will be appreciated that this invention may be carried out by making provision for increasing the damping of the half wave resonances, or for neutralizing the power perturbations caused by them, or for utilizing a combination of those techniques to reduce the unwanted power perturbations that are caused by such half wave resonances.

What is claimed:

1. In an acoustic ink printer including a printhead having a supply of liquid ink with a free ink surface; an acoustic cavity of finite length containing said ink, with one end of said cavity being defined by said free ink surface; a droplet ejector acoustically coupled to said ink: and a pulse modulated rf signal source coupled to said droplet ejector for exciting said droplet ejector to radiate said free ink surface with substantially focused acoustic power pulses, whereby individual droplets of ink of controlled size are ejected from said free ink surface on command at a controlled ejection velocity; the improvement wherein said signal source supplies a plurality of rf frequency components for exciting said droplet ejector, said frequencies being selected to produce resonant and anti-resonant reflections within said cavity that substantially counteract each other at said free ink surface, thereby inhibiting said reflections from materially perturbing the acoustic power at said free ink surface.

2. The improvement of claim 1 wherein said signal source supplies a pair of rf frequencies at amplitude levels which are scaled to cause their resonances and anti-resonances to substantially equally and oppositely perturb the acoustic power at said free ink surface.

3. The improvement of claim 1 wherein said signal source has a broad frequency spectrum and a substantially uniform signal amplitude across said frequency spectrum, and said printhead is configured to couple many of the frequencies within said spectrum into said ink within the passband of a single resonance of each of said frequencies within said ink, whereby the acoustic power perturbations caused by the resonances and anti-resonances of said frequencies tend to neutralize each other at the free ink surface.

4. The improvement of claim 3 wherein said signal source includes a pseudo-random bit generator for supplying a cyclical bit sequence signal, and means for frequency modulating a rf carrier in accordance with said pseudo-random signal.

5. The improvement of any of claims 2 through 4, inclusive, or 1 wherein said means for suppressing said power perturbations further includes an acoustically lossy ink for amplitude attenuating the reflected radiation sufficiently to significantly dampen said resonances and anti-resonances.

6. The improvement of any of claims 2 through 4, inclusive, or 1 wherein each of said droplet ejectors comprises a spherical acoustic focusing lens for launching said converging acoustic radiation into said ink.

* * * * *